US006138797A

United States Patent [19]

Pettersson et al.

[11] Patent Number: 6,138,797

[45] Date of Patent: Oct. 31, 2000

[54] PROCEDURE AND APPARATUS FOR INSTALLING THE OVERSPEED GOVERNOR OF AN ELEVATOR

[75] Inventors: Håkan Pettersson, Solna, Sweden; Mark Peacock, Hyvinkää, Finland; Istvan Toth, Kista, Sweden

[73] Assignee: Kone Corporation, Helsinki, Finland

[21] Appl. No.: 09/180,552

[22] PCT Filed: Mar. 6, 1998

[86] PCT No.: PCT/FI98/00206

§ 371 Date: Jan. 6, 1999

§ 102(e) Date: Jan. 6, 1999

[87] PCT Pub. No.: WO98/40304

PCT Pub. Date: Sep. 17, 1998

[30] Foreign Application Priority Data

Mar. 7, 1997 [FI] Finland ..... 970971

[51] Int. Cl.[7] ..... B66B 5/06

[52] U.S. Cl. ..... 187/286; 187/413; 187/900

[58] Field of Search ..... 187/239, 254, 187/226, 413, 900

[56] References Cited

U.S. PATENT DOCUMENTS

| | | | |
|---|---|---|---|
| 3,519,101 | 7/1970 | Seiffert | 187/256 |
| 3,759,349 | 9/1973 | Seiffert | 52/745.2 |
| 3,763,964 | 10/1973 | Davis | 187/239 |
| 5,033,586 | 7/1991 | Richards et al. | 187/239 |

FOREIGN PATENT DOCUMENTS

| | | |
|---|---|---|
| 0767134A2 | 4/1997 | European Pat. Off. . |
| 10417 | 6/1993 | Japan . |
| 61731 | 8/1993 | Japan . |
| 228445 | 2/1994 | Japan . |
| 247077 | 3/1994 | Japan . |

*Primary Examiner*—Jonathan Salata
*Attorney, Agent, or Firm*—Birch, Stewart, Kolasch & Birch, LLP

[57] ABSTRACT

The invention relates to a procedure and an apparatus intended to be used in elevator installation to install the overspeed governor (28) for the time it takes to install the elevator. According to the invention, when the elevator is being installed, at least one suspension element (17) is fastened to the upper part of the elevator shaft (2), an element (30) supporting the overspeed governor (28) is fitted to the suspension element and the position of the overspeed governor (28) at least in the vertical direction is so adjusted that it corresponds to the final placement of the overspeed governor (28). After the elevator guide rails (56) have been installed, the overspeed governor is removed from the suspension element (17) and fixed to a guide rail.

20 Claims, 3 Drawing Sheets

PROCEDURE AND APPARATUS FOR INSTALLING THE OVERSPEED GOVERNOR OF AN ELEVATOR

This application is the national phase under 35 U.S.C. §371 of prior PCT International Application No. PCT/FI98/00206 which has an International filing date of Mar. 6, 1998 which designated the United States of America, the entire contents of which are hereby incorporated by reference.

FIELD OF THE INVENTION

The present invention relates to a procedure and to an apparatus for installing an elevator.

DESCRIPTION OF THE BACKGROUND ART

The installation of an elevator is a critical stage in a building project. The elevator must be available for use as early as possible during the construction period. It is desirable that the elevator should function at this stage in the same way as it will in a finished building, and e.g. the safety equipment must be in operation. On the other hand, the elevator should be installed as quickly as possible without causing disturbances in other construction work. Special installations intended for the installation and construction period should be kept to a minimum and the elevator should be directly installed in its final form to avoid the need for later adjustments and trimming. The elevator must be installed quickly and economically. Additional features to the standard requirements are encountered in the installation of an elevator without machine room, in which all the shaft equipment must be mainly installed in the shaft space.

SUMMARY OF THE INVENTION

The object of the present invention is to create a new and economical solution for the installation of an elevator.

According to the invention, during the installation of the elevator the overspeed governor is at least in the vertical direction so adjusted that it corresponds to the final placement of the overspeed governor and after the elevator installation the overspeed governor is detached from the suspension element and fixed in its final mounting point. An element for supporting the overspeed governor is fitted to a suspension element. Further, the overspeed governor is preferably mounted on the suspension element and its position at least in the vertical direction is adjusted to the final position of installation of the overspeed governor and the overspeed governor ropes are adjusted substantially to their final length. The overspeed governor can be utilised during elevator installation and its final installation is easy to carry out and requires no rope length adjustment.

By using the solution of the invention, the shaft equipment for an elevator can be installed quickly and reliably. Installation-time overspeed governor installation can be done from the top floor landing. As the overspeed governor is now operational, work safety in elevator installation is substantially improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described by the aid of a few of its embodiments by referring to the drawings which are given by way of illustration only, and thus are not limitative or the present invention, and in which.

DETAILED DESCRIPTION OF THE PREFERRED EMBODIMENTS

Figure 1:
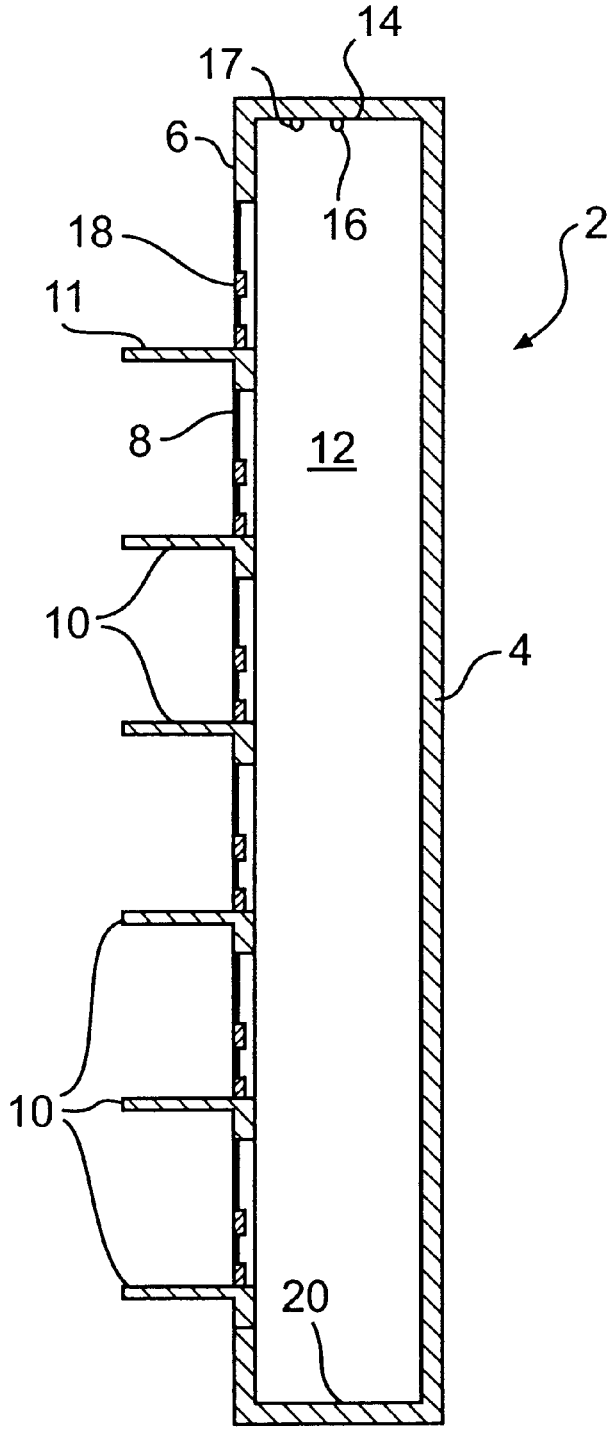
FIG. 1 presents an elevator shaft before the elevator is installed.

FIG. 1 shows a cross-section of the elevator shaft 2 before installation of the elevator. The shaft comprises a back wall 4 and front wall 6 with door openings 8 at the landings 10 and 11, and side walls 12. Fixed to the shaft ceiling 14 are suspension elements, such as suspension loops 16, 17 and 19, to be used in the installation. There are three suspension loops fixed to the shaft ceiling, of which the first suspension loop 16 is used to mount a hoisting device, the second suspension loop 17 is used for temporary installation of the overspeed governor and the third suspension loop 19 is used during installation as an auxiliary suspension means when installing other shaft components, which not described in this context. The shaft extends somewhat below the lowest floor, forming a pit in which the shaft equipment needed below the elevator car is installed. The door openings are provided with temporary safety walls 18, which may consist of e.g. plastic plates, wooden beams or steel bars.

Figure 2:
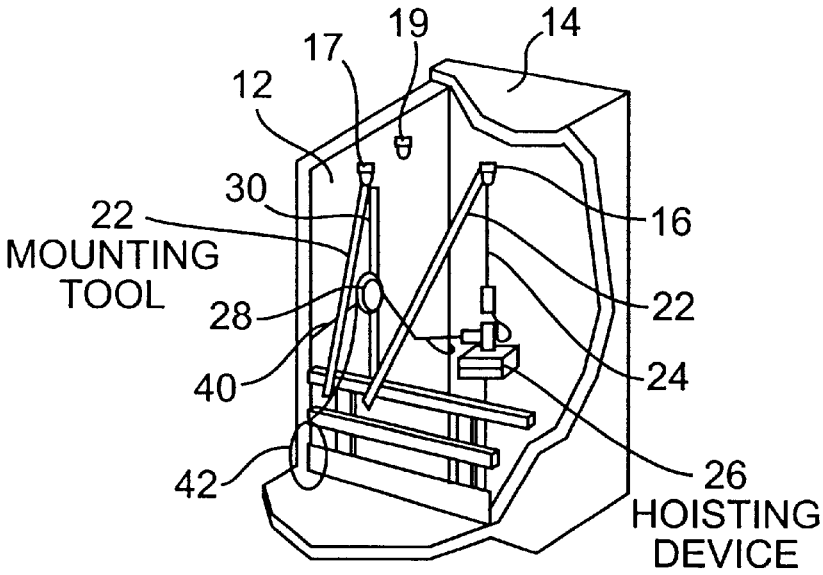
FIG. 2 presents the upper part of the shaft when the overspeed governor is being mounted.
Figure 3:
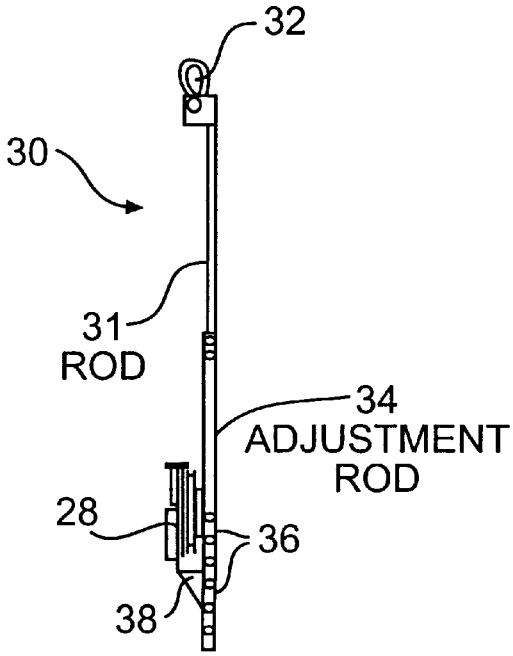
FIG. 3 presents a means for mounting the overspeed governor.

As illustrated by FIG. 2, a suspension means such as a suspension rope 24 is fixed to the suspension loops 16 in the shaft ceiling using a mounting tool 22. The mounting tool has a slot at one end, to which a clamp at the end of a rope can be fitted. Using the mounting tool, the clamp can be set on the suspension loops by means of a fast coupling working on the top floor 11. The suspension rope is fastened to a hoisting device 26, by means of which the shaft equipment can be hoisted from the shaft bottom to the mounting height. Using the mounting tool 22, an installation-time frame 30 for the overspeed governor 28 is mounted on suspension loop 17. The frame 30 (FIG. 3) comprises a fastening hook 32 fitted to the end of a rod 31, allowing it to be mounted on a suspension loop 17, and an adjusting bar 34 fitted to the other end of the rod. The adjusting bar is provided with a series of mounting holes 36, in which a mounting base 38 for the overspeed governor can be fixed. The final mounting height 40 of the overspeed governor in the elevator shaft is marked on the side wall 12 and the overspeed governor is mounted at the correct height by fixing it by the mounting holes in the adjusting bar. After the overspeed governor 28 has been fixed to its installation-time position, the overspeed governor rope 42 is fitted into the groove of the rope pulley of the overspeed governor and dropped into the shaft and fitted onto a diverting pulley mounted in the bottom part of the shaft. The overspeed governor rope is adjusted to its final length, whereupon the overspeed governor is ready for use in elevator operation during installation. After the installation, the overspeed governor is removed from its installation-time frame and fixed to an elevator guide rail at the same height.

The guide rails for the elevator car and counterweight are installed starting from the bottom of the shaft and proceeding upward one rail at a time. The last section of one of the car guide rails is installed together with the drive machine 58 of the elevator. The elevator drive machine 58 is fixed to the guide rail section 56 on the bottom floor and, using an installation hoist, the machine-guide rail combination is hoisted through the bottom-floor door opening and through the gap between the elevator car and the door opening into the shaft and further up the shaft to the top floor landing 11.

Figure 4:
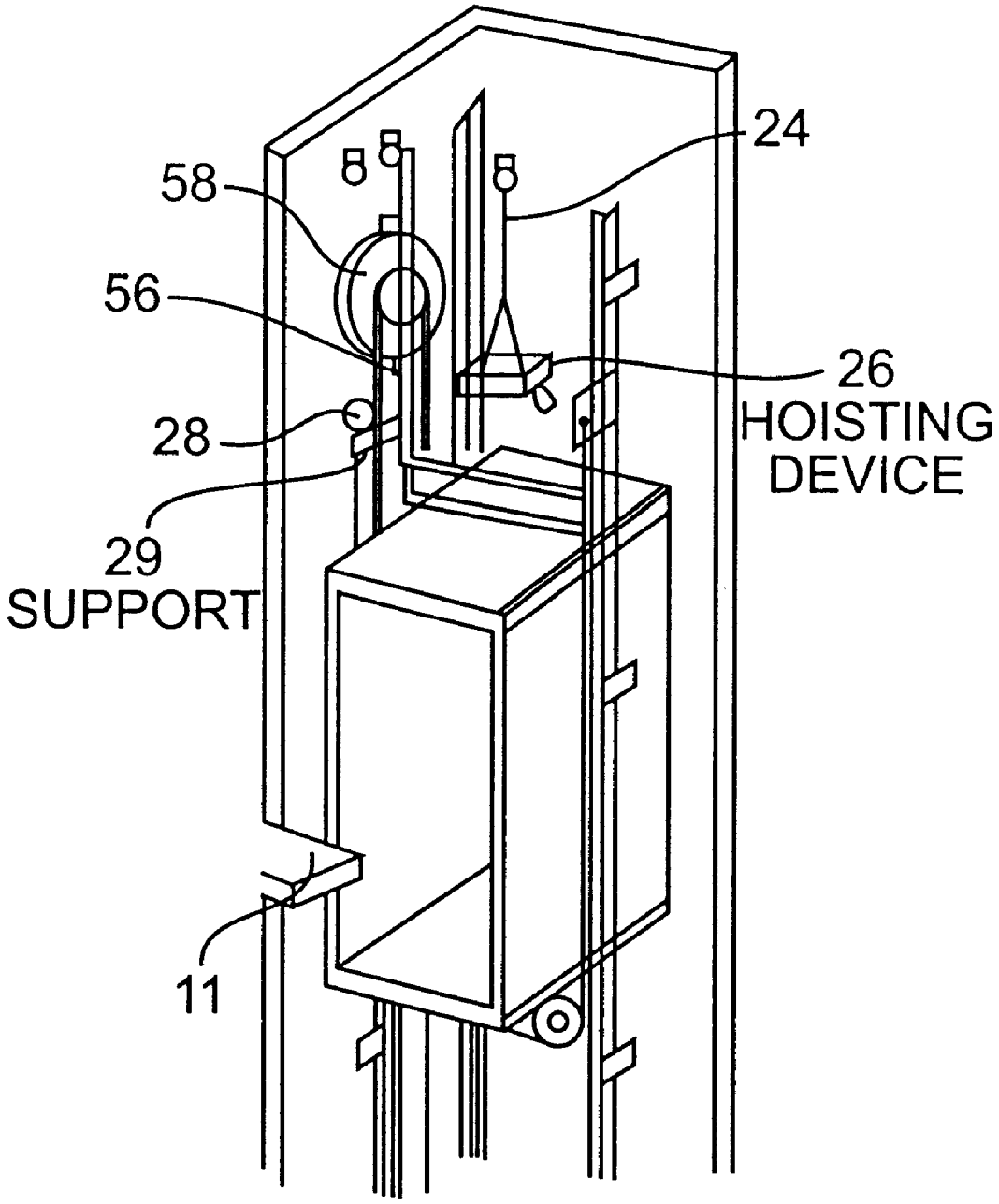
FIG. 4 presents the upper part of the shaft with the installation finished.

After the elevator machinery has been installed, the overspeed governor 28 is removed from its installation-time mounting and installed in its final place on a support 29 attached to the guide rail 56. FIG. 4 presents the upper part of the elevator shaft with the drive machine, guide rails and overspeed governor installed.

In the foregoing, the invention has been described by the aid of one of its embodiments. However, the presentation is not to be regarded as constituting a restriction of the sphere of patent protection, but the embodiments of the invention may be varied within the limits defined by the following claims. For instance, instead of being fixed to the shaft ceiling, the suspension element may as well be attached to an element provided in the upper part of the shaft, such as a supporting beam fixed to the shaft walls.

What is claimed is:

1. A procedure for installing an overspeed governor of an elevator comprising the steps of:

fitting the overspeed governor to a suspension element during the installation of the elevator, the suspension element being fastened to an upper part of the elevator shaft;

adjusting a position of the overspeed governor at least in a vertical direction to correspond to a final placement of the overspeed governor; and detaching the overspeed governor from the suspension element after elevator installation and fixing the overspeed governor in a final mounting point, a vertical height of the overspeed governor at the final placement during the step of adjusting being a same vertical height as the final mounting point after the step of detaching.

2. The procedure as defined in claim 1, further comprising the steps of:

fitting an element for supporting the overspeed governor to the suspension element fixing the overspeed governor to at least one elevator guide rail when the overspeed governor is in the final mounting point and after installation of the at least one elevator guide rail.

3. The procedure as defined in claim 1, further comprising the step of fastening the suspension element to a ceiling of the elevator shaft.

4. The procedure as defined in claim 1, further comprising the step of adjusting a length of rope of the overspeed governor to substantially its final length, the step of adjusting occurring before the step of detaching the overspeed governor from the suspension element.

5. The procedure as defined in claim 1, further comprising the step of supporting the overspeed governor at a final stage of installation by a hoisting device attached to a suspension device, the overspeed governor being fixed in its final mounting position.

6. The procedure as defined in claim 1, further comprising the step of fixing the overspeed governor to a guide rail when the overspeed governor is in the final mounting point.

7. The procedure as defined in claim 1, further comprising the step of installing the overspeed governor supporting element and the overspeed governor from a top floor, the top floor being a final top floor served by the elevator after the step of detaching the overspeed governor from the suspension element is completed.

8. The procedure as defined in claim 1, further comprising the step positioning the overspeed governor in the elevator shaft during this step of fixing the overspeed governor in the final mounting point whereby a machine room for the overspeed governor can be avoided.

9. A procedure for installing an overspeed governor of an elevator comprising the steps of:

fitting the overspeed governor to a suspension element during the installation of the elevator, the suspension element being fastened to an upper part of the elevator shaft;

adjusting a position of the overspeed governor at least in a vertical direction; and detaching the overspeed governor from the suspension element after elevator installation and fixing the overspeed governor in a final mounting point, the final mounting point being within the elevator shaft such that a machine room for the overspeed governor can be avoided.

10. The procedure as defined in claim 9, further comprising the step of fixing the overspeed governor to at least one elevator guide rail when the overspeed governor is in the final mounting point.

11. The procedure as defined in claim 9, further comprising the step of fastening the suspension element to a ceiling of the elevator shaft.

12. The procedure as defined in claim 9, further comprising the step of adjusting a length of rope of the overspeed governor to substantially its final length, the step of adjusting occurring before the step of detaching the overspeed governor from the suspension element.

13. The procedure as defined in claim 9, further comprising the step of supporting the overspeed governor at a final stage of installation by a hoisting device attached to a suspension device, the overspeed governor being fixed in its final mounting position.

14. The procedure as defined in claim 9, further comprising the step of fixing the overspeed governor to a guide rail when the overspeed governor is in the final mounting point.

15. The procedure as defined in claim 9, further comprising the step of installing the overspeed governor supporting element and the overspeed governor from a top floor, the top floor being a final top floor served by the elevator after the step of detaching the overspeed governor from the suspension element is completed.

16. An kit for installing shaft equipment for an elevator, the kit comprising a suspension element which is attachable to one of a ceiling and an upper part of a wall of the elevator shaft, and a support, the support supporting the overspeed governor by the suspension element at least during installation of the elevator.

17. The kit according to claim 16, further comprising a mounting tool for setting the support on the suspension element from the top floor.

18. The kit according to claim 17, further comprising an overspeed governor for the elevator, the top floor being a final top floor served by the elevator after installation of the overspeed governor is completed.

19. The kit according to claim 17, wherein the mounting tool comprises a bar with one end provided with a device for the mounting of shaft equipment.

20. The kit according to claim 16, further comprising a mounting base, an overspeed governor and adjusting elements, the mounting base holding the overspeed governor, the adjusting elements adjusting the overspeed governor at least to a final height position.

* * * * *